United States Patent [19]

Sullivan

[11] Patent Number: 4,487,211

[45] Date of Patent: Dec. 11, 1984

[54] SHEARING COMB

[76] Inventor: Judy C. Sullivan, 2543 S. Delaware, Springfield, Mo. 65804

[21] Appl. No.: 490,787

[22] Filed: May 2, 1983

[51] Int. Cl.[3] ..... A45D 24/36

[52] U.S. Cl. ..... 132/45 R

[58] Field of Search ..... 132/45 R, 11 R; 30/211–214, 30, 85

[56] References Cited

U.S. PATENT DOCUMENTS

| | | | |
|---|---|---|---|
| 1,175,023 | 3/1916 | Szabo | 30/30 |
| 1,642,532 | 9/1927 | Beauregard | 30/212 X |
| 1,878,549 | 9/1932 | Sireci | 30/30 |
| 2,008,631 | 7/1935 | Udkovich | 30/211 |
| 2,650,421 | 9/1953 | Wietzel | 30/30 |
| 2,725,886 | 12/1955 | Gagliano | 30/30 X |
| 3,384,960 | 5/1968 | Solomon | 30/30 |

*Primary Examiner*—Gregory E. McNeill

*Attorney, Agent, or Firm*—Thomas M. Scofield

[57] ABSTRACT

Improvements in hairstyling and barbering tools; a single implement for hairstyling combining therein the functions of combing and cutting; a combing/blunt cutting/bevel blending/hairstyling tool with a reciprocable member controllably moving cutting tines with respect to combing tines; the reciprocable element actuated by the index finger of the operator's tool carrying hand; a hairstyling tool for both combing and cutting carried by, used in and operated by one hand of the hairstylist or operator.

7 Claims, 14 Drawing Figures

SHEARING COMB

BACKGROUND OF THE INVENTION

The three basic tools of a barber or hair stylist for male and female customers have always been, most typically, separate shears (scissors), razor and comb. In normal and conventional use, the barber or stylist employs one half of the standard comb as a handle, with the other half being used as a comb. The shears or razor themselves are typically held in one hand, while the comb is shifted back and forth between hands, as the client's hair is being cut, styled, or whatever.

For example, if combing out a lock or section of hair to be trimmed, the stylist, if right handed, would grasp the lock(s) of hair in the left hand, shift the comb from the left hand to the right hand, comb the lock(s) out to the position or the length desired, grasp them in a fixed position with the fingers of the left hand, clamping the hair to be cut between the fingers of the left hand, shift the comb back to the left thumb for holding and, then, cut the excess hair off with the shears or razor in the right hand. Thereafter, the comb is shifted back and forth between the stylist's, user's or operator's hands until another trimming, shearing or blending cut or operation takes place.

The basic purpose of the subject device and invention is to professionally and practically combine the three basic tools of the hair stylist into a single instrument in order to enable combing and cutting (all the activities of the styling operation) to be much less awkward and even more accurate than the present day method using separate comb, razor and shears. In order to accomplish this, a single precision device is provided which will enable full, complete and precise use thereof in all the combing and sectioning operations as well as and all of the shearing, trimming, blending and styling operations of a barber or hair stylist to be carried out without hindrance or impedance, indeed, with facilitation, by the operator.

As will be seen from the prior art patents listed, the broad concept of a combined combing and cutting device is not new. However, a versatile, effective, optimum such device is not available or has not appeared. Thus this development.

BRIEF DESCRIPTION OF THE INVENTION

In the preferred form seen in the drawings described in the specification, a shearing comb is provided made up of certain elements. Such include paired handle halves which receive the interlocked comb and cutting blades. One rigidly fixed (with respect to the handle halves) comb blade is removably fitted into a slot in one of the handle halves. The cutting blade, having a grasping tine extending upwardly thereabove, lies against the comb blade, in sliding abutment therewith, in face to face relationship. This cutting blade, received in the slotted opposite handle half, may reciprocate to and fro with respect to the fixed handle halves and fixed comb blade structure. Spring means operate to normally return the cutting blade into a position where its teeth overlie and are in precise registry with the teeth of the comb blade so that there is no cutting action without positive effort applied by the operator or stylist.

In use, the subject device is designed to be grasped by the normal working hand of the stylist or operator. The other hand (say the left hand in a normally right handed operator) would be completely free of tools. If the stylist is combing a lock (or locks) or section of hair out for trimming, the right hand carries the device through the hair. The device may be stopped at any point or length during the stroke and the cut may be initiated at any angle desired. Alternatively, after such lock(s) are combed, they could be grasped by the left hand in a controlling position for fixing the cutting length. In the latter case, the comb probably would be carried out of the hair and then returned by the same (right) hand to engage and shear the hair. No shifting of implements is required or takes place (unless the operator wants to change hands with the device in use).

A skilled operator or hair stylist, once adept with the subject new device, will be able to operate with greater precision and a reduction of hand movements of approximately two thirds or 66%.

THE PRIOR ART

Applicant is aware of the following listed patents directed to analogous goals or subject matter:

Szabo U.S. Pat. No. 1,175,023 "Hair Cutting Instrument", issued Mar. 14, 1916;

Henry U.S. Pat. No. 1,391,635 "Hair Cutter", issued Sept. 20, 1921;

Spencer U.S. Pat. No. 1,491,320 "Combined Clipper, Comb and Shears" issued April 22, 1924;

Loughmiller U.S. Pat. No. 1,866,475 "Hair Cutter", issued July 5, 1932;

Udkovich U.S. Pat. No. 2,008,631 "Hair Thinning Device", issued July 16, 1935;

Strezoff U.S. Pat. No. 2,192,054 "Hair Clipper", issued Feb. 27, 1940;

Adams U.S. Pat. No. 2,260,205 "Barber's Shingling Clipper", issued Oct. 28, 1941;

Gent U.S. Pat. No. 2,738,579 "Cutting Device", issued Mar. 29, 1956;

Shapin U.S. Pat. No. 2,741,842 "Combined Comb And Hair Cutting Device", issued April 17, 1956;

Ford U.S. Pat. No. 3,711,948 "Hair Trimming Device", issued Jan. 23, 1973;

Broussard U.S. Pat. No. 3,805,381 "Hair Styling Device", issued April 23, 1974; and Edwards U.S. Pat. No. 4,020,549 "Hair Cutter Comb", issued May 3, 1977.

OBJECTS OF THE INVENTION

A first object of the invention is to provide substantial new improvements in tools for the hair stylist's and barber's profession and trade, specifically, an improved device combining, in a new way, the hair stylist's shears (scissors) razor and comb. (This device may be used to cut, etc. human hair, the "hair" of wigs and like materials.) Another object of the invention is to provide such a single device embodying the functions of comb, shears and razor where the shearing, cutting or scissoring action is obtained by longitudinal translation of a portion of the device at right angles to the comb tines.

Another object of the invention is to provide such a combined comb and shears where the shearing action is at right angles to the combing action and is accomplished by the crooking of the operator's or stylist's finger, without any requirement of a full hand gripping action as is common in most shears and scissors.

Another object of the invention is to provide a novel hair stylist tool and device which has only one moving part, performs both combing and cutting functions, does not damage the hair cuticle and provides a familiar, straight handle on the comb such as the comb that the stylist uses customarily in every day use.

Another object of the invention is to provide such a combined combing and cutting device which, in addition to the conventional combing and cutting functions can cut a blend in the hair by tilting the device backwardly or forwardly and, further, can blunt cut if the device is to be held straight.

Other objects of the invention are to provide a simple, precision, integral, long lived device able to perform the recited functions which can be taken apart easily for cleaning, sharpening, repair and maintenance and which has a long life under continuous and arduous use. (Yet further, such a device which is easily and simply manufactured of precision made elements and, while made of the highest grade materials for precision action throughout long life, nevertheless is exceedingly cheap for the value provided in use and operation.)

Still another object of the invention is to provide such a described device which can section, comb and cut (all) without much more effort than is required in only combing the hair and, further, can cut hair of any length from one sixteenth of an inch to knee length.

Other and further objects of the invention include the provision of a device which will not dull easily, has a minimum number of working parts, is readily useable by either a left handed or right handed stylist, requires a minimum of hand movement to actuate the cutting blade, can blend the hair, section hair, performs all styling operations equally well with long and short hair, does not lose accuracy with the scissor action, does not accidentally cut hair not intended to be cut and wherein, at all times, the action of the device is fully visible to the eyes of the stylist. Yet further, the stylist is essentially working with a familiar instrument, specifically, basically, a hair comb structure and configuration.

Another object is to provide a safe cutting device which has no exposed sharp points or edges which would endanger the client or stylist in all its varied modes of use and action.

Other and further objects of the invention will appear in the course of the following description thereof.

DRAWINGS

In the drawings, which form a part of the instant specification and are to be read in conjunction therewith, embodiments of the invention are shown and, in the various views, like numerals are employed to indicate the like parts.

STRUCTURE AND FUNCTION

Figure 3:
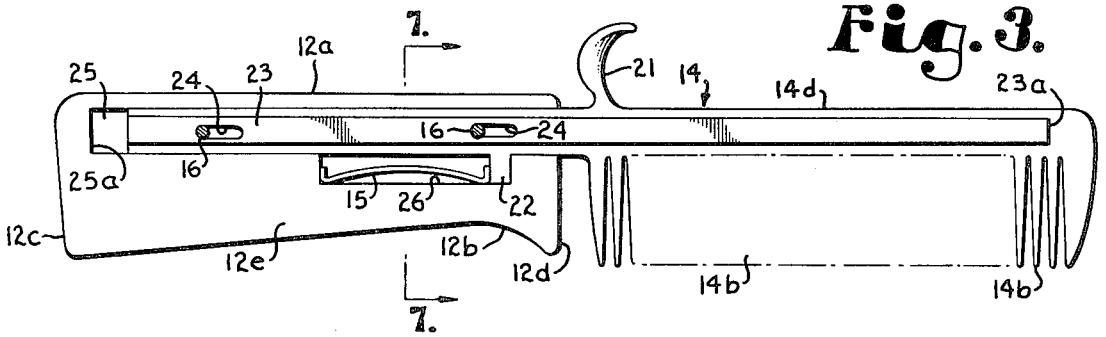
FIG. 3 is a side view of the device of FIGS. 1 and 2 with the handle half adjacent the viewer in the views of FIG. 1 and 2 and the fixed blade received therein removed in order that the viewer can see the inner or inboard face of the reciprocating blade and its receipt and positioning within its half of the handle.
Figure 4:
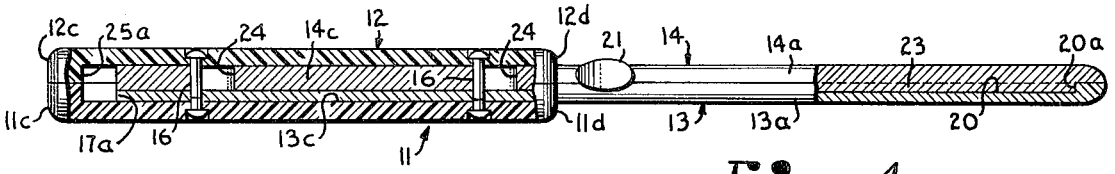
FIG. 4 is a vertical plan view, from above, of the device of the previous three figures with portions of the handle and blades cut away to better show the internal construction of both.
Figure 5:
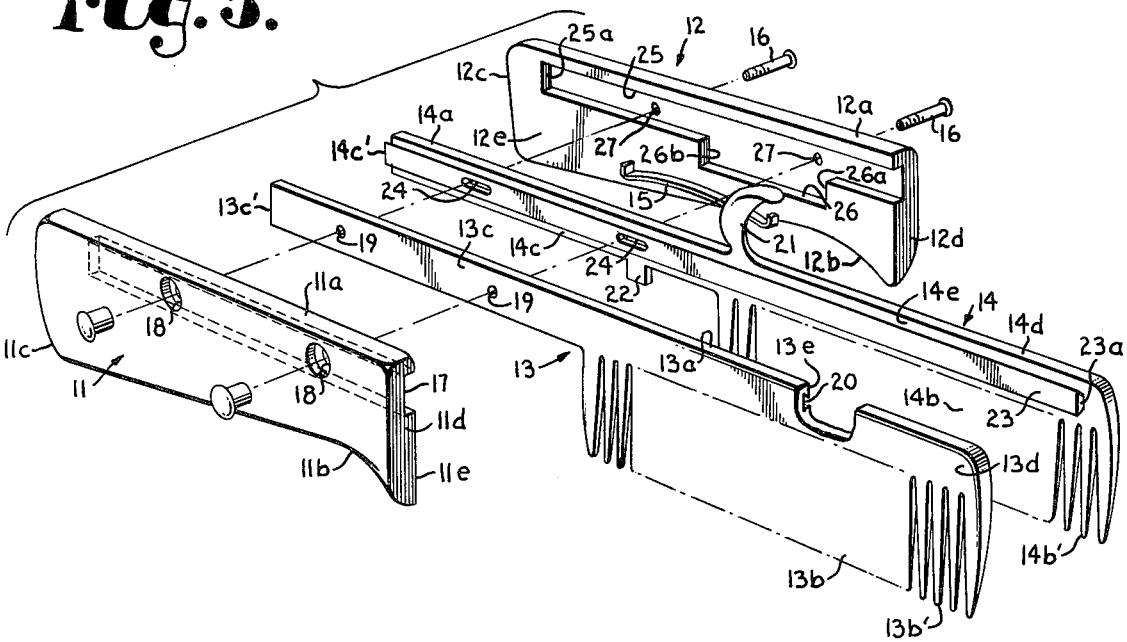
FIG. 5 is an exploded view of the parts of the device of the four previous figures in three quarter perspective view from above and the front, somewhat similar to view of FIG. 1, but exploded. (The dotted line showings and cutaways are provided to better illustrate the construction of the parts of the device.)

Referring to the drawings and to the particular device seen in FIGS. 1–7, inclusive, therein is shown the preferred form or modification of the subject combined comb and shears or scissors. Referring first to FIG. 5, wherein the basic parts of the device are seen in exploded view, these parts may be basically or generally identified as:

(1) The handle elements, particularly identified and designated as the comb handle 11 (or comb handle element or portion 11) and the cutter handle 12 (or cutter element handle portion or element 12);

(2) The comb element 13;

(3) The cutter, shear or scissor element 14;

(4) Spring or return element 15; and (5) Connectors (bolts, screws, rivets or the like) 16.

These are the basic elements of the device generally designated and they will now be more particularly characterized and described.

Figure 1:
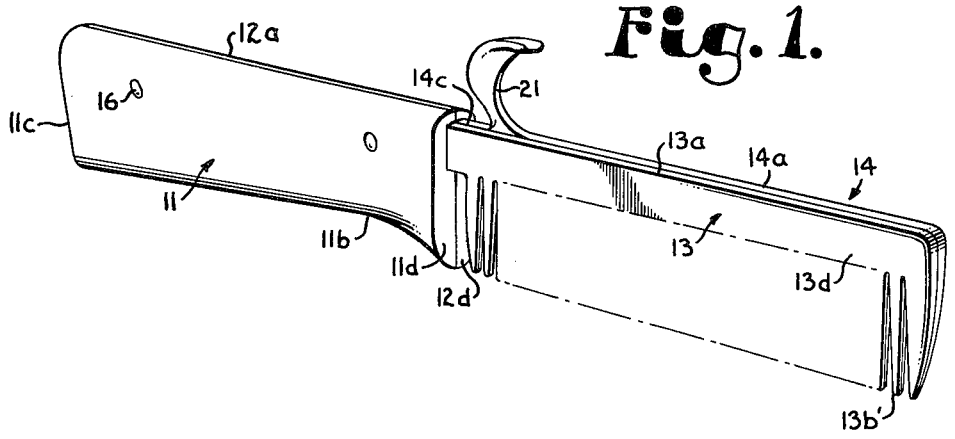
FIG. 1 is a three quarter perspective view, from above, of a first form of the subject invention with the tines or blades of the device in combing position. (In this view, the fixed blade is nearest the viewer and the reciprocating or cutting blade is away from the viewer.)
Figure 2:
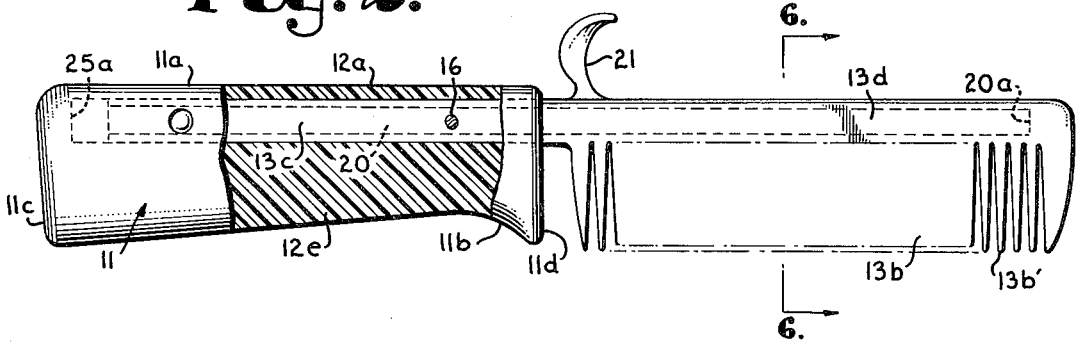
FIG. 2 is a side view of the device of FIG. 1 with a portion of the handle nearest the viewer cut away to show the inner, handle end of the fixed blade nearest the viewer.

Comb handle element 11, as may particularly be seen in FIGS. 1, 2 and 5, typically has a straight upper edge 11*a* and a curved and somewhat inwardly tapered lower edge 11*b*. The outer end 11*c* may have rounded upper and lower end edges with the end wall typically somewhat inwardly inclined (to the right in FIG. 2 as shown). The inboard wall 11*d* is preferably straight and may also have rounded upper and lower ends thereto as seen in the views. A rectangular groove or slot 17 is formed, molded, cut or otherwise provided in the inner face 11*e* of element 11 adjacent the upper edge 11*a* thereof and oriented substantially parallel thereto. Bolt or rivet passages 18 are provided through comb handle portion 11 within the zone (in a wall thereof) of groove or slot 17. These may have recessed or tapered walls on the outside and are fastener passages for bolts, rivets, screws or the like, specifically, any conventional fastener.

Comb element 13 has straight upper wall 13*a*, comb tine toothed front under portion 13*b* and rectangular, lesser size inner base portion 13*c* with outer end wall 13*c*'. Further, this element is provided, in inboard portion 13*c* thereof, with registering passages 19 (to jibe with passages 18 in handle portion 11) to receive fasteners therethrough. Still further, a frusto-conical groove 20 is provided within the inboard wall of comb element 13, adjacent the upper end thereof, this groove (see FIGS. 6 and 7 for configuration) extending the entire length of end portion 13*c* and also within the upper portion of the comb tine end 13*d* to stop 20*a* (FIG. 4 on the right). Groove 20 is parallel to the upper edge 13*a* of element 13. The comb tines 13*b*' in zone 13*b* may be rounded on their outboard (toward the viewer in FIGS. 1, 2, 4 and 5) portions, but must be flat on their inboard faces and aligned, in straight line fashion, with the upper inboard face of element 13 at 13*d*.

The third element of the combination above noted comprises the cutting or shearing element generally designated 14. Before describing this element, however, it is noted that the end element 13*c* frictionally and closely fits (so that it will not work therewithin, either inwardly or outwardly, up or down or pivotally) within groove 17 of handle element 11. Additionally, the teeth or tines 13*b*' are preferably configured in the following manner. First, the outboard portions thereof (toward the viewer in the figures mentioned previously) are preferably rounded in transverse section. On the other hand, the inboard faces thereof must be flat for face to face, flush abutment with the cutting tines to be described. Yet further, on the inboard side, vertical edges of the comb tines preferably have essentially a curved, but sharp cutting edge thereto to cooperate with the cutting element tines.

Looking, then at element 14, at 14*a* there is provided a flat, straight upper edge which is designed to be, adapted to be and does lie parallel with, flush with and in line with edge 13*a* of element 13 when the device is assembled. An index finger grasping tang 21 is fixed to or formed integral with element 14 and extends vertically upwardly therefrom (edge 14*a*), while being arcuate and configured for engagement by and actuation by the index finger or thumb of the operator's comb working hand in normal use. The length of element 14 (see FIG. 4) is preferably exactly that of element 13 but may differ somewhat therefrom (or vice versa) so long as the working relationship of these two parts is permitted by the sizing of these elements. The inboard, lesser depth or dimension portion of element 14 is numbered 14*c*, this, again, preferably being of a depth equal to portion 13*c* of element 13. Fixed to or integral with the underside thereof is projection or post 22, such extending downwardly at right angles to bar 14*c* and preferably of the same thickness thereof. The cutting (also comb) tine portion of element 14 is designated 14*b*, the cutting, (also comb) tines thereof being designated 14*b*'. An elongate, frusto-triangular (in section) flange or rib 23 is fixed to or formed integral with the inboard face 14*e* of element 14, extending at substantial right angles thereto and also extending substantially the entire length thereof, save for the front end portion 23*a* thereof. The length of rib or flange 23 is preferably precisely the inboard length of groove or slot 20 in element 13 and is configured to frictionally but slidably fit therein in precise, moving juxtaposition. Slotted openings 24, adapted to register with openings or passages 18 and 19 in elements 11 and 13 are provided through rib 23 and bar portion 14*c* of element 14, whereby to permit and receive the extension therethrough of fastener elements to be described.

As previously mentioned, the lengths of elements 13 and 14, including bar portions 13*c* and 14*c* thereof, as well as the outer ends 13*d* and 14*d* thereof, are preferably precisely the same. However, while the depth (or height) of bar portions 13*c* and 14*c*, as well as upper, outer end portions 13*d* and 14*d*, are preferably the same, the length of the cutting tines 14*b*' (see FIG. 6) is preferably somewhat less than the length of the comb tines 13*b*' in order that there be no (or a minimum of) catching of hair at the terminus of the comb tines. The tines extending past the blades are preferably rounded at the lower end thereof to avoid a sharp or rough edge to irritate the scalp.

Coming to element 12, the opposite handle side, this cutter handle or cutting element handle portion 12 has flat, straight upper edge 12*a* lower configured edge 12*b* (reversedly congruent to 11*b*), rear end or edge 12*c* and front end or edge 12*d*. Flat inboard face 12*e* is provided to abut against flat inboard face 11*e* of element 11. Slot or groove 25 is sized the same, in the major portion thereof, as slot or groove 17 and is designed to be opposed to slot 17 and match same when the handle elements 11 and 12 are juxtaposed and fastened together with the comb and cutting elements received therewithin. The inner end 25*a* of slot 25 is preferably the same length as that of slot 17 (as may be seen in FIG. 4), as the inner end of slot 17 must be extended to receive ridge 23 moving therein on the cutting action. Yet further, there is provided a recess or cavity 26 in groove or slot 25 in the lower edge thereof, somewhat forward of the midportion thereof, having forward and rearward walls 26*a* and 26*b*. Finally, passages 27 extend through element 12 in slot 25 to register with slots 24 and passages 19 and 18 in the other elements.

The spring element 15 may be of varied length and configuration, but here is shown as an arcuate length of steel arched upwardly centrally and having upwardly turned free ends thereon.

In order to assemble the device, including the elements as previously described, first, the outer end 23*a* of flange 23 is inserted into the inner end (at 13*c*') of slot 20 in element 13. Element 14 is then slid along element 13 until the combing (and cutting) elements 13*b*' and 14*b*' are aligned as seen in FIG. 4. At this point, flange end 23*a* abuts slot end 20*a*. The two engaged elements 13 and 14, in this position, are then fitted into handle element 12 with the outboard edge of downward projection 22 abutting the outboard face 26*a* of recess 26. At this point, fasteners 16 may be inserted into passages or openings 27, 24 and 19. Next to last, then, spring 15 is inserted into recess 26 between wall 26*b* and the inboard face of projection 22 in somewhat compressed position so that, through the tension or action applied to projection 22, element 14 is forced into the position seen in FIGS. 3 and 4. Finally, then, handle element 11 is fitted over end portion 13*c* so that inboard face 11*e* thereof abuts flush against inboard face 12*e* of element 12. The nuts, end connections or screw-on, threaded ends of fasteners 16 are then inserted in passages 18 and a rigid, face to face connection of elements 11 and 12 effected. In the event that fasteners 16 do not provide sufficient rigid connecting force to always rigidly hold together handle elements 11 and 12, additional openings 18 and 27 may be provided between the handle elements free of the slot (and recess) zones to provide such continuous monolithic connection. As may be seen in FIG. 7, the passages 18 and 27 may be recessed for the heads of the connectors, as desired.

Assuming that elements 13, 14 and 15 are of high grade steel, possibly stainless steel for maximum precision construction and longevity, handle elements 11 and 12 may be advantageously made of the same high grade steel material, plastic, fiberglass or the like. However, since there is going to be a frictional action or movement of element 14 in slot 25 and movement of element 22 in recess 26, as well as flexing and return of spring 15, and, additionally, the fit of portions 13*c* and 14*c*, as well as 22, in the slots and recesses must be most precise: frictional, but movable, the inboard faces of the slots, grooves and recesses (or other parts) may be teflon or other tough material faced, if desired.

In the event that it is desired to replace spring 15, clean or oil any of the elements, replace any of the elements, sharpen or reshape the comb and/or cutting tines, etc., the fasteners merely need be loosened, removed and the parts disengaged from one another. Reassembly is as previously described.

The tang may be of any desired shape (element 21), but must comfortably fit the operator's index finger from either side. It is the flange or rib 23 in groove 20 that holds the blades together in precision position and action, but the fit of the slots 17 and 25 with respect to the element portions 13*c* and 14*c* must be precise to (1) hold the assembly rigid with respect to the handle (in and out, up and down and pivotally) and (2) also permit the action of the cutting element 14 in the cutting operation, as well as its return due to the impetus of spring 15.

With respect to the action of the cutting element 14 in the cutting operation and return, there are certain zones of the device which must be precisely sized for optimum effect, these being particularly visible with respect to FIG. 3:

(1) Zone "a" is the available or free space within the ends of slots 25 and 17 when cutting element 14 is fully returned under the action of spring 15.

(2) Zone "b" is the length of slots 24 in element 14, portions 14*a* and 23 thereof.

(3) Zone "c" applies both to the outboard face of tang 21 moving toward abutment with handle face 12*d* and the inboard face of the innermost cutting tooth of the set 14*b*'.

(4) Zone "d" is the distance from the inboard edge of the outermost cutting tooth of the set 14*b*' to the center of the third cutting tooth or third comb tine (which are the same since, in base, nonactuated position, the cutting and combing elements overlie and align with one another perfectly).

(5) Zone "e", the distance from stop 20*a* to the end of the cutter element, is to insure coverage of groove 20 to prevent hair or debris from entering the groove.

All of the distances a, b, c, d and e must be at least equal, although a and c may be slightly greater than b and d in order that the slots 24 control the stop, rather than the impact of the outboard end 14*c*' of portion 14*c* of element 14 on face 25*a* and the tang inboard surface (and/or the tine (most inboard) inboard surface) both on face 12*d*. Other spacings may be employed and will work, but this is the optimum arrangement in the structure disclosed and described in FIGS. 1–7, inclusive.

Figure 6:
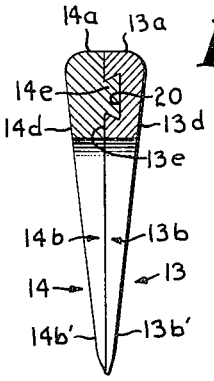
FIG. 6 is a view taken along the line 6—6 of FIG. 2 in the direction of the arrows.
Figure 7:
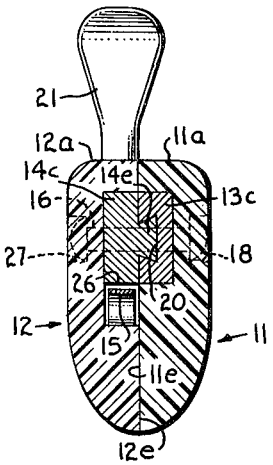
FIG. 7 is a view taken along the line 7—7 of FIG. 3 in the direction of the arrows.

For and in the actual hair styling and cutting action, it should not be required that the blade move more than one tooth or tine. However, a short pull could leave hair uncut. Thus it is best to provide a safety measure of a two tine pull. As previously mentioned, the cutting and comb teeth should align perfectly when in nonactuated position (no pull on tang) thus to comb through the hair straightly. Spring 15 must be sufficiently strong and of such high grade material as to have a long life without losing its elasticity or force. Various forms of spring may be employed, including compression, coil or zig zag springs, etc. What is preferred is that elements 13 and 14 be of the same thickness, as is seen in FIGS. 4, 6 and 7. Alternatively, element 13 may be of greater thickness than the cutting element 14.

The operation of the device, when assembled, is very simple. When the tang 21 is not drawn toward handle face 12*d*, the device is used in perfectly conventional manner as a comb. The operator may handle, use and orient this comb in every way and manner conventional without any hindrance whatsoever. To employ the device in a cutting action, however, when the comb is engaged with the hair and the lock or section to be worked is held by the operator, the operator need only draw tang 21 to the left end in the views of FIGS. 1–5, inclusive, thus sliding the cutting tines across and past the comb blades and tines. When the device is held straight or at right angles to the client's hair, the cutting action is a blunt cut. When the comb is held with the upper edges 11*a*, 13*a*, 14*a* and 12*a* higher with respect to the scalp than the tine ends are, a blending action may be effected. This sort of blend is now done with a razor. Thus, a first new action is achievable with this device.

Next, should the back or ridge portions 11*a*, 13*a*, 14*a* and 12*a* be held downwardly toward the scalp as compared with the cutting and combing tine ends, a blend can be created that no present tool (of which the inventor is aware) can cut accurately and safely. The inventor has heard stylists ask how such a blend could be created, only to be told (by instructors) that there is no way that such can be accomplished (with conventional tools). This entirely new action and effect is very useful. Additionally, on the style line (next to the face and neck) an undercut is typically effected by first cutting one section, then cutting the next one slightly longer. The subject device can do this in one section.

An alternative spring configuration of advantage involves a slot provided in the outboard face of projection 22 intermediate the height thereof with an arcuate spring provided having a flat end extension to enter this slot. The outboard end of the spring would be rounded and reinforced downwardly. Alternatively, a leaf spring of arcuate central form analogous to that seen in FIGS. 3 and 5 may be employed, but with the curvature reversed on the outboard end. The arcuate portion 11*b* of the handles 11 and 12 is optional, but preferred, because it affords, in effect, a thumb rest for the operator and gives greater control as the comb/shears is positioned variously with respect to the user's hand and the client's hair.

FIGS. 8 AND 9

Figure 8:
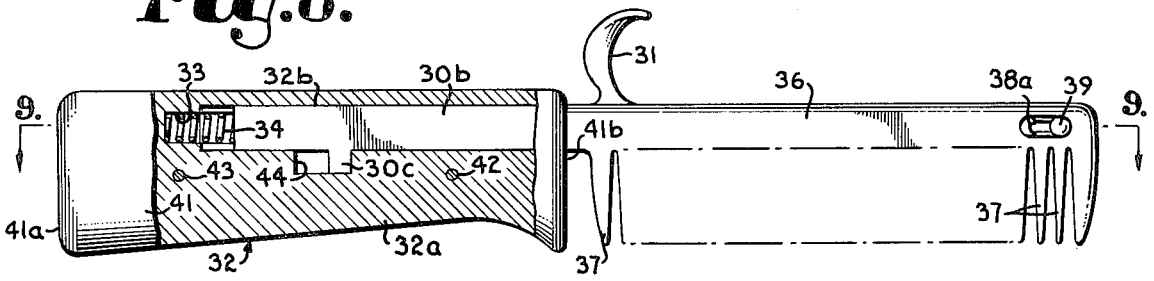
FIG. 8 is a side view (analogous to FIG. 2) of a first modified form of the subject device with a portion of the handle nearest the viewer cut away to better illustrate the mounting of the reciprocating blade in the handle half positioned away from the viewer.
Figure 9:
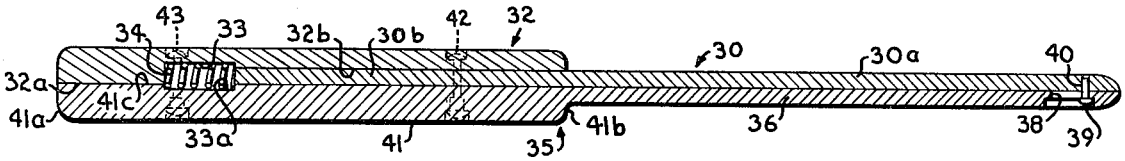
FIG. 9 is a view taken along the line 9—9 of FIG. 8 in the direction of the arrows.

Referring to FIGS. 8 and 9, therein is shown an extremely simplified version of the subject device. In these views, the comb element is made integral with its corresponding handle portion. In effect, that is, handle portion 11 and comb element 13 of FIG. 5 are made integral with one another. Because of this, it is necessary that at least that portion of the handle be made of metal, as is the comb element. With one such handle portion being metal, then, preferably, the other handle portion, for symmetry and appearance, is also preferably of metal. However, the latter is not necessarily the case and the independent handle portion, in its structure as will be described, may be of plastic or wood. Preferably the entire device of these figures is of stainless steel.

Referring then, to these figures, at 30 is generally designated the cutting element which has a tine carrying spine 30*a* and an elongate base portion 30*b*. There is additionally provided finger grasping tang 31 on spine 30*a* near its inboard end. Cutting element 30 is analogous in structure to element 14 as seen in FIG. 5 but omitting rib 23 and openings 24 therefrom.

The cutting element handle portion 32 is quite comparable to handle element 12 seen at right center in FIG. 5. Handle element 32 has inboard flat face 32*a* within which, adjacent the upper edge thereof, there is provided elongate slot 32*b*. At the left hand end of slot 32*b* in FIGS. 8 and 9, there is provided an enlarged, spring holding recess 33 adapted to receive spring 34 therewithin to abut against the left hand end of cutting element base portion 30*b*, thus providing resilient bias of the cutting element 30 to the right in FIGS. 8 and 9. Spring 34 is sized so as to be compressible in its recess so that the cutting element 30 can reciprocate at least one full tines width to the left in the views of FIGS. 8 and 9 (and preferably two tines width). The cutting tines on spine 30*a* are not seen in FIGS. 8 and 9 but are present and are sized and of a number like the tines on the comb element to be described.

The other half (comprising a combined combing element and handle portion) of the tool or device of FIGS. 8 and 9 is generally designated 35. The right hand end of this element, in FIGS. 8 and 9, comprises an elongate tine bearing spine 36 having comb tines 37 formed integral therewith. An elongate, slotted opening 38 is provided through spine 36 at the right hand end thereof in the figures, this opening having inwardly recessed or tapered edges 38*a* on the upper and lower portions thereof at the right hand end thereof in the views. A pin 39 having an enlarged head is fixed in an opening 40 in the opposed end portion of cutter element spine 30*a*, whereby to hold the spine portions 30*a* and 36 (as well as the corresponding tine elements) in juxtaposition during use, including when the cutting action is employed.

The left hand end of element 35 is a matching, opposable handle portion 41 (to handle element 32) having a left hand end 41*a* and a right hand end 41*b*. The inboard face of handle portion 41 is flat, save for spring recess portion 33*a* therein, such matching spring recess portion 33 in element 32. Thus the flat inboard face of element 41 flatly rests against inboard face 32*a* of handle element 32 and against the face of the cutting element base portion 30*b* received in groove or recess 32*b*. The inboard face of element 41 is designated 41*c*. Screw elements 42 and 43 removably fix elements 35 and 32 together with cutting element base 30*b* therebetween with spring 34 in recess 33, 33*a*.

In order to disassemble the device of FIGS. 8 and 9, screws 42 and 43 are removed. At this point, the spring 34 can be removed from recess 33, 33*a* by separating the handle halves, one from the other. Then, by the tang 31, pin 39 is moved to the left so that it can be freed of retaining edges or flanges 38*a* and thus be removed through the left end of opening 38.

It can be seen that the excess length of the recess 32*b* and the length of the slot 38 must be at least substantially the same, with the latter preferably somewhat longer by the space necessary to clear pinhead 39. The clearance of tang 31 from the handle portion 32 must be preferably at least this distance also. Such distance is preferably at least that distance where the matched comb and cutting tines of the elements of FIGS. 8 and 9 are displaced (those on the cutting element) at least one full tine to the left in the view to achieve the full cutting action. A two tine displacement is preferred. The size, shape, action, registry, etc. of the tine elements of this form is the same as described with respect to the devices of the other figures.

The device of FIGS. 8 and 9 is preferably entirely constructed of high grade stainless steel.

FIGS. 10 AND 11

This construction is closely analogous to the construction of FIGS. 1–7, inclusive. The difference is that the flange or rib 23 of element 14 in FIG. 5 is removed therefrom and made a separate and shorter element. By providing a shorter slot through, instead of in, element 13 of FIG. 5, a simpler, more easily manufactured and more precisely controllable engagement of the combing and cutting element is providable.

Figure 10:
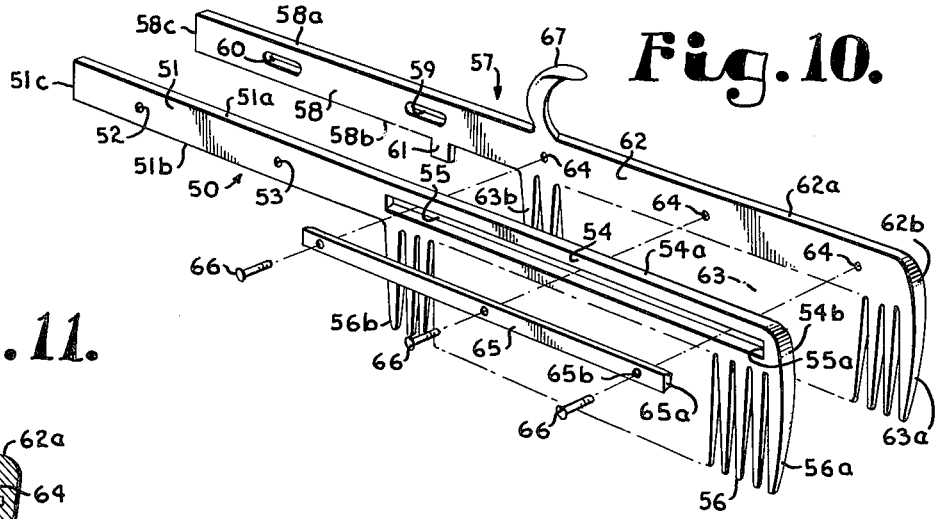
FIG. 10 is an exploded view of certain parts of a second modification of the subject device in three quarter perspective view from above and the front. This view is somewhat similar to that of FIG. 5, but omits the handle elements therefrom and shows a different mode of clamping the cutting and combing blades of the device together with respect to one another.
Figure 11:
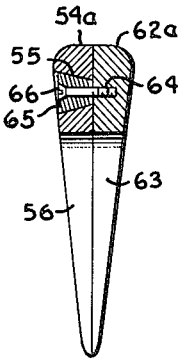
FIG. 11 is a vertical section taken through the assembled device of FIG. 10 showing the manner of connection together of the combing and cutting blades. This view is sectional in its upper portion and is taken approximately one third of the way along the distance between engagement of the rib within the slot of the combing blade.

In FIGS. 10 and 11, comb element 50 has elongate base portion 51 with top edge 51*a* and bottom edge 51*b*, as well as inboard end 51*c*. Portion 51 is essentially rectangular. It is comparable to element 13*c* of FIG. 5. Passages or openings 52 and 53 are provided therethrough. The other part of element 50 comprises elongate spine 54 having top edge 54*a* continuous with top edge 51*a* and outboard end edge 54*b*. A frusto-conical slot 55 is provided running substantially the length of spine 54 and parallel with the upper edge 54*a* thereof. This slot narrows from left to right in the view of FIG. 10 as may be most clearly seen in FIG. 11. Comb tines 56 are provided on the lower side of spine 54, the outbcard tine being 56*a* and the inboard tine being 56*b*.

Referring to the cutting element of FIG. 10, this is seen at the right hand side of the figure and is generally designated 57. This is the movable element of the assembly, strictly comparable to element 14 of FIG. 5. Elongate, rectangular handle element 58 has flat upper edge 58*a* and parallel, flat lower edge 58*b*, as well as inboard end 58*c*. Slots 59 and 60, opposed to openings 53 and 52, respectively, are provided in member 58, as well as downwardly extending post or member 61. The right hand side of member 57 has upper spine 62 with upper edge 62*a* continuous with upper edge 58*a* of member 58 and outboard edge 62*b*. Tines 63 are provided on the underside of spine 62 with the outboard tine being 63*a* and in the inboard tine being 63*b*. As is the case in the devices of FIGS. 1–7, inclusive and 8 and 9, an equal number of tines are provided on each of the spines of the device, such substantially equal in size and configuration and with equal spacing therebetween so that, when edges 54b and 62b are aligned, all of the tines are opposite one another with a uniform combing space therebetween (see FIG. 2). A plurality of openings 64 (here shown as 3 in number) are provided into spine 62 of cutting element 57 opposed to slot 55. As can be seen in FIG. 11, these openings are internally threaded and do not extend all the way through spine 62 but merely thereinto sufficient for a threaded engagement with bolt or screw members to be described.

The means for slidably engaging the comb element 50 and cutting element 57 with respect to one another is an elongate, frusto-conical (in transverse section see FIG. 11) beam 65. Beam 65 is adapted to fit within slot 55 (as seen in FIG. 11) and is engaged with member 57 by virtue of screws or bolts 66 which threadably engage the internally threaded holes 64 in spine 62, also seen in FIG. 11. Beam 65 is shorter than slot 55. When cutting element 57 is at its furtherest outboard position (arrangement of FIG. 3), the outboard end 65a of beam 65 is in abutment with the outboard end 55a of slot 55 or closely approaching same. The views of FIGS. 3 and 4 are applicable to the construction of FIGS. 10 and 11. Specifically, the element 61, like post 22 will be at the right hand end of a like recess to recess 26 in the equivalent handle portion 12. The screws or fasteners (not seen in FIG. 10) through openings 52 and 53 and slots 60 and 59, corresponding to screws 16 in FIG. 5, will be at the left hand ends of slots 59 and 60. Accordingly, the cutting element 57 must be able to move to the left in FIG. 10 in its handle recess (like recess 25 of element 12 of FIG. 5) a distance corresponding to at least one full tine's width from center of one tine to center of the next tine to obtain the proper cutting action. This distance is mirrored in the lengths of the slot 60 and 59 and the excess of length of the slot 55 over the length of beam 65. A two tine possible translation or movement of cutter element 57 with respect to comb element 50 is preferred.

Thus it may be seen that the handle elements 11 and 12, as well as screws 16 and spring 15 of FIG. 5 all would be identically used with the construction of FIGS. 10 and 11. The only difference between the construction of FIGS. 10 and 11 and that of FIGS. 1–7, inclusive is the different engagement between the cutting element 57 and the handle element 51 via beam 65 in slot 55 engaged with spine 62 by screws 66.

Said otherwise, no changes need to be made in handle elements 11 and 12, as well as screws 16 and spring 15 for these elements to properly and operably engage and enclose the handle elements 51 and 58 of the cutter and handle elements 57 and 50 of FIGS. 10 and 11. Accordingly, the structure of these elements is here incorporated by reference and the operation of the device of FIGS. 10 and 11 is the same as previously described with respect to FIGS. 1–7, inclusive.

In this operation, the hair stylist or operator engages tang 67 on spine 62 with one finger when the cutting action is desired, moving the tang and thus element 57 to the left in the view of FIG. 10. This will be the same as moving element 14 to the left in FIGS. 2, 3 and 5 against the action of spring 15. The comb element handle extension 50 remains fixed in position with respect to the handle elements because of the close fit of the bolts or pins (equivalent to 16) through the openings 52 and 53 thereof.

COMBING AND CUTTING TINE VARIATIONS

In the construction of FIGS. 1–7, inclusive, the comb and cutter tines are assumed to be each essentially a half circle in transverse section (horizontal section in the views of FIGS. 2 and 3) and of substantially equal thickness at the equivalent height. However, the cutter tines 14b' have lower terminating ends which preferably end short of the lower terminating ends of the comb or handle portion tines 13b'. The cutter tine ends are preferably tapered sharply onto the inboard faces of the lower comb tine ends, while the comb tines 13b are preferably rounded at the lower end thereof to avoid scalp irritation.

The view of FIG. 11 is a view taken opposite in direction to the view of FIG. 6. That is, it is a view looking from right to left in the view of FIG. 10 through the assembled structure between the tines. It also shows one of the screws 66 and is thus a view taken at one of the screw passages 65b through beam 65 and an internally threaded opening 64 in spine 62. The construction of FIG. 11 is intended to show the comb element or portion tines 56 and cutter element tines 63 in an arrangement where they are truly equal in size and of like configuration in their entire length. In transverse, horizontal sections in FIG. 11, the tines, at the various heights, would be equal size and preferably substantially half circle in configuration. Thus, in this case, the comb and cutting tines are of the same length, same thickness and lie face-to-face in their entire length when juxtaposed (no cutting action). These tines could be made deep oval or near parabolic in section, optionally. Such, while perhaps requiring more precision in manufacture to insure the proper cutting action, would nevertheless allow easier passage to the hair in combing and working action. Additionally, the more metal that is present, the more strength is present in the tine at each level.

Figure 12:
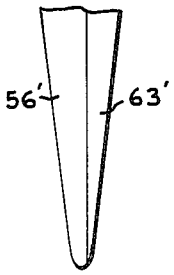
FIG. 12 is a fragmentary front view of one form of cutting and combing tine assembly where the cutting tine is of a lesser width and slightly lesser length than the combing tine.
Figure 13:
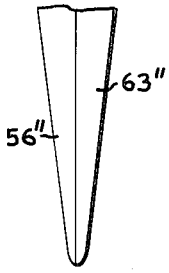
FIG. 13 is a fragmentary view like that of FIG. 12 but showing the cutting tine of slightly greater size than the combing tine.
Figure 14:
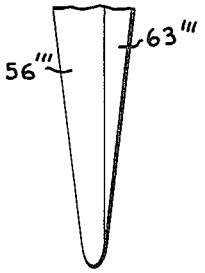
FIG. 14 is a fragmentary view like FIGS. 12 and 13 showing a considerably shorter and narrower cutting tine associated with a considerably stouter and longer combing tine.

FIGS. 12, 13 and 14 are variant tine construction options taken from the view of FIG. 11. That is, the cutting tine is on the right hand side of each view, while the comb element tine is on the left hand of the view. Thus, FIG. 12 is an enlarged detail of the lower end of tines equivalent to those seen in FIG. 6, but taken from the other side or looking in the other direction. The cutter and comb tines in the views of FIGS. 12–14, inclusive are numbered the same as in FIG. 11, because they are substantially equivalent, but primed, double primed and triple primed, respectively.

In FIG. 12, it can be seen that, as previously stated, in the preferred embodiment, the cutter tine 63' ends before the comb tine 56' ends and tapers sharply thereagainst or thereinto. The comb tine 56' is rounded at the lower end.

FIG. 13 is not a preferred modification, showing the cutter and comb tines as substantially the same length and thickness, but the cutter tine slightly thicker than the comb tine and the comb tine faired or tapered onto the cutter tine. Again, the latter is somewhat rounded at its lower end.

FIG. 14 is an exaggeration of the constructions of FIG. 12 and FIG. 6. That is, the cutter tine is of considerably less thickness, particularly at its lower end, than the comb or handle tine, fairing sharply (or tapering) to a sharp lower edge which lies against the inboard face of the comb tine above the latter's rounded end. This form provides greater protection to the scalp of the subject being hair styled, but has less strength in the cutter tine lower ends.

In the constructions where the comb element tines extend below the cutting tines, such extension may vary from as much as one sixth of an inch in a construction as seen in FIG. 14 to, typically, one sixteenth to one thirty second of an inch with respect to the forms of FIGS. 12 and 6.

It is to be understood that the inboard abutting faces of the comb and cutting elements are to be provided with that slight curvature of the elements which cause the comb tines and cutting tines to maintain a tension against one another to aid in the cutting process. An exact fit of the blade faces in sliding action is not sufficient. Pressure on the cutting side, which is the left hand end of the tines in FIGS. 2 and 3, thus must be provided to give a pressure which is not found on the opposite side of the tines.

In scissors, the blades are each provided with a face-to-face arcuate shape or twist toward the cutting edge. In the present construction, a slight twist is provided on the tines of the cutter element whereby the left hand side (in the views of FIGS. 2 and 3) presses down, thus applying an edge pressure, while the right hand side in the views indicated slightly lifts away from the combing blade. This lift is so slight that it does not hinder the work of the comb. Such arcuate curvature of the cutting tine is so slight that it does not show in the subject drawings.

In FIG. 8 recess 44 in handle portion 32 with element 22 attached to base portion **30*b*** are optionally provided for axial rotational stability and additional stop provision if desired.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A combined comb and hair cutting instrument comprising, in combination:

(1) a first elongate, flat comb element having an elongate flat, substantially rectangular, inner base extension thereon, (2) a second elongate, flat cutting element also having an elongate flat, substantially rectangular inner base extension thereon, (3) said comb and cutting elements each including a normally straight elongate outer, upper spine with a like plurality of substantially individually alike lower tines fixed and extending at substantial right angles thereto, said tines each spaced apart from one another a like distance for hair combing action when said elements are lengthwise aligned with one another, (4) said elements and extensions of substantially congruent size, shape and form in the several parts thereof with substantially flat, opposed abuttable inboard faces adapted for longitudinal axial sliding motion of the cutting element and its base extension with respect to the comb element and its base extension, (5) a pair of grasping handle pieces adapted to receive therewithin and therebetween the comb and cutting element inner base extensions, (6) said grasping handle pieces of matched, substantially like, congruent form with flat, opposing inboard faces adapted to flatly abut against one another in engaging relationship to form an integral grasping handle, (7) each said grasping handle piece having an elongate groove positioned in the inboard face thereof adapted to receive therewithin one elongate, inboard base extension of the comb or cutting elements, (8) means communicating between the comb and cutting element spines for normally holding said elements in close, face-to-face, sliding frictional contact while permitting the longitudinal axial movement or reciprocation of the cutting element and its attached base extension with respect to the comb element and its base extension in their engagement with the handle elements and one another, (9) means fixed to the upper spine portion of the cutting element for operative finger or thumb engagement therewith for reciprocating said cutting element and base extension thereof with respect to the comb element and its base extension, as well as the integral grasping handle, and

(10) means interconnecting the two handle pieces through the cutter and comb element base extensions in such manner as to fix said handle pieces together, maintain said base extensions in face-to-face axial sliding relationship and permit the cutter element and its base extension to axially reciprocate with respect to the said integral grasping handle and the comb element and its base extension,

(11) there being means normally biasing said movable cutting element and its base extension to a comb action position with juxtaposed element tines in congruent registering position with the comb element and its base extension.

2. A device as in claim 1 wherein said biasing means is received within said integral grasping handle and acts upon the base extension of the cutter element.

3. A device as in claim 1 wherein the means communicating between the comb and cutter element spines comprises an elongate, frusto-conical section flange mounted on the inboard face of the spine one of said elements and its base extension, said flange engageable in an elongate groove provided in the opposed, inboard face of the spine of the other element and its base extension.

4. A device as in claim 1 wherein said means communicating between the comb and cutter element spines comprises an elongate, frusto-conical section flange slideably receivable in a slot formed through one of said elements, said flange removably attachable to the opposed inboard face of the spine of the other element.

5. A combined comb and hair cutting instrument comprising, in combination:

(1) a first elongate, flat comb element, (2) a secono elongate flat cutting element having an elongate flat, substantially rectangular inner base extension thereon, (3) said comb and cutting elements each including a normally straight, elongate outer, upper spine with a like plurality of substantially individually alike lower tines fixed and extending at substantial right angles thereto, said tines each spaced apart from one another a like distance for hair combing action when said elements are lengthwise and edgewise aligned with one another, (4) said elements of substantially congruent size, shape and form in the several parts thereof with substantially flat, opposed, abuttable, inboard faces adapted for longitudinal axial sliding motion of the cutting element with respect to the comb element, (5) a first grasping handle piece connected to the spine of said comb element of greater length and depth than the base extension of said cutting element, (6) a second grasping handle piece of congruent and opposite form to the first grasping handle piece integral with said comb element, (7) said grasping handle pieces, in addition to being of matched, substantially like, oppositely congruent form having flat, opposing inboard faces adapted to flatly abut against one another in engaging relationship to form an integral grasping handle, (8) said second grasping handle piece having an elongate groove positioned in the inboard face thereof adapted to receive therewithin the elongate, inboard base extension of the cutting element, (9) means communicating between the comb and cutting element spine for normally holding said elements in close, face-to-face, sliding frictional contact while permitting the longitudinal axial movement or reciprocation of the cutting element and its attached base extension with respect to the comb element and its handle piece extension in the latter's engagement with the second handle piece,

(10) means fixed to the upper spine portion of the cutting element for operator finger or thumb engagement therewith for reciprocating said cutting element and base extension thereof with respect to the comb element, as well as the integral grasping handle, and

(11) means interconnecting the two handle pieces in such manner as to fit said handle pieces together as an integral grasping handle, maintain the cutter base extension in face-to-face axial sliding relationship with the comb element handle piece and permit the cutter element and its base extension to axially reciprocate with respect to said integral grasping handle and the comb element,

(12) there being means normally biasing said movable cutting element and its base extension to a comb action position with juxtaposed element tines in congruent registering position with the comb element.

6. A device as in claim 5 wherein said biasing means is received within said integral grasping handle and acts on the base extension of the cutter element.

7. A device as in claim 5 wherein the means communicating between the comb and cutter element spines comprises an enlarged headed pin fixed at the opposite end thereof from said enlarged head to the inboard face of the cutter element spine, said pin and enlarged head received in an elongate, recessed slot in said comb element spine.

* * * * *